United States Patent [19]

Shanly

[11] 4,083,633

[45] Apr. 11, 1978

[54] BLADE CLEANING HOLDER

[75] Inventor: Alan L. Shanly, Webster, N.Y.

[73] Assignee: Xerox Corporation, Stamford, Conn.

[21] Appl. No.: 700,438

[22] Filed: Jun. 28, 1976

[51] Int. Cl.[2] ..... G03G 21/00

[52] U.S. Cl. ..... 355/15; 15/245; 15/256.51

[58] Field of Search ..... 355/15; 15/245, 256.51

[56] References Cited

U.S. PATENT DOCUMENTS

| | | | |
|---|---|---|---|
| 2,948,012 | 8/1960 | Scott | 15/256.51 |
| 3,014,833 | 12/1961 | Lee | 15/256.51 X |
| 3,848,992 | 11/1974 | Smith | 355/15 |
| 3,973,845 | 8/1976 | Lindblad et al. | 355/15 |

FOREIGN PATENT DOCUMENTS

| | | | |
|---|---|---|---|
| 519,346 | 12/1955 | Canada | 15/256.51 |
| 919,745 | 2/1963 | United Kingdom | 15/245 |

*Primary Examiner*—Fred L. Braun

[57] ABSTRACT

In a copying apparatus where image developer material is cleaned from a reusable imaging surface by a resilient cleaning blade, one edge of the blade is mounted within a blade retaining channel with opposing generally parallel walls spaced apart by a distance slightly greater than the thickness of the blade to provide unobstructed ingress of the cleaning blade mounting edge against a linear base of the channel without compression of the blade. The blade mounting channel has an arcuate intermediate bend resiliently bending the cleaning blade within the channel sufficiently to cause the cleaning blade to resiliently frictionally engage both walls of the channel to frictionally retain the blade and to seal the channel from the image developer material.

3 Claims, 1 Drawing Figure

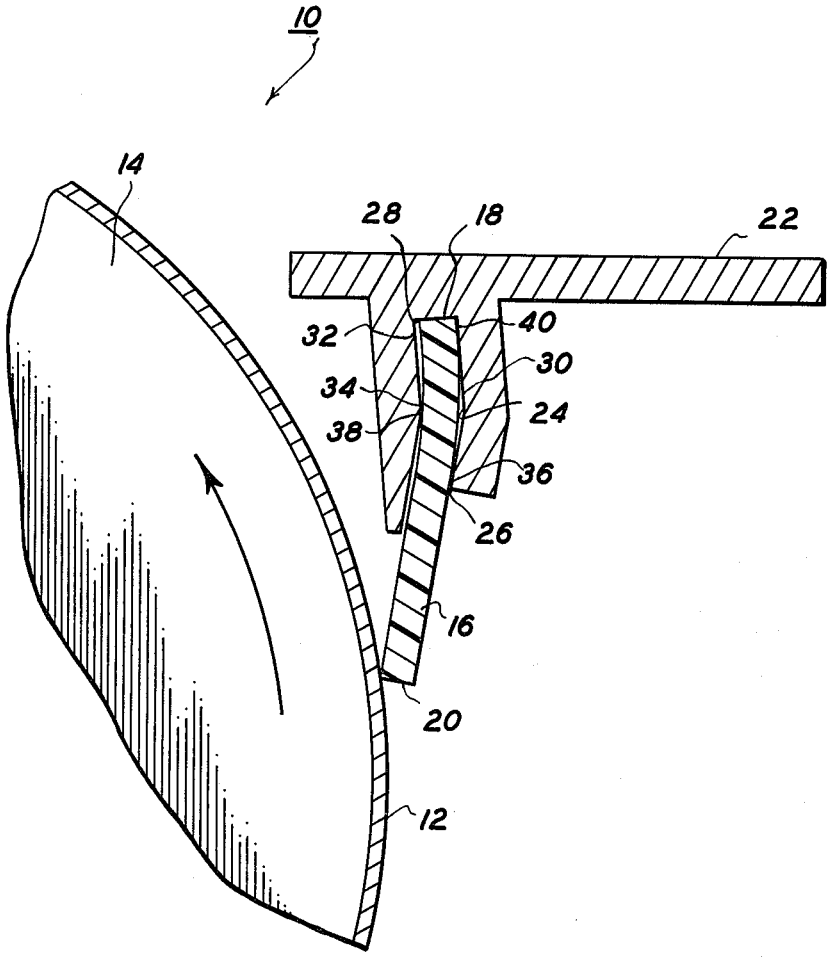
10
14
28
18
22
32
40
30
34
24
38
36
26
16
20
12

BLADE CLEANING HOLDER

This invention relates to copying systems and, more particularly, to an improved blade cleaning apparatus for cleaning electrostatographic image developer material from an imaging surface, with improved blade retention.

The development and cleaning of imaging materials on a reusable imaging surface in electrostatography is well-known. In xerography, for example, a latent electrostatic image is optically formed on a photoconductive imaging surface and developed by depositing on the latent image a finely divided dry electroscopic visible image developer material known in the art as toner. This toner image may then be electrostatically transferred and permanently fixed to a support surface such as paper. However, after such transfer, residual toner remains on the photoreceptor, which for reuse thereof must be removed by a cleaning operation at a cleaning station. This cleaning of residual toner from the photoreceptor must be accomplished rapidly and thoroughly yet without damage to the delicate photoreceptor, and the removed toner must be appropriately disposed of. The residual toner is tightly retained on the photoconductive surface and is difficult to remove. This retention is believed to be caused both by electrical charge attractions and by Van der Waals forces that prevent complete transfer of the toner to the support surface. Also, a small percentage of the toner can be wrongly charged, or uncharged, either initially or by virture of the cleaning operation. However, once the toner is removed it can disperse and contaminate the components of the cleaning and other apparatus within the copier unless properly handled. Thus, cleaning of the imaging surface is one of the more difficult technical problems in practical xerography. Conventional photoreceptor cleaning devices are brush type cleaning apparatus, web type cleaning apparatus, or blade type cleaning apparatus. The present invention relates to blade cleaning systems.

Exemplary xerographic photoreceptor blade type dry toner cleaning apparatus is disclosed in U.S. Pat. Nos. 3,438,706, issued April 15, 1969, to H. Tanaka et al.; 3,552,850, issued Jan. 5, 1971, to S. F. Royka et al.; 3,634,077, issued Jan. 11, 1972, to W. A. Sullivan; 3,660,863, issued May 9, 1972, to D. P. Gerbasi; 3,724,019, issued Apr. 3, 1973, to Alan L. Shanly; 3,724,020, issued Apr. 3, 1973, to Henry R. Till; 3,740,789, issued June 26, 1973, to Raymond G. Ticknor; 3,848,992, issued Nov. 19, 1974, to Richard E. Smith; 3,848,993, issued Nov. 19, 1974, to Christ S. Hasiotis; 3,847,480, issued Nov. 12, 1974, to Donald J. Fisher, and 3,871,762, issued Mar. 18, 1975, to Wilhelmus Van der Vlasakker. Toner cleaning systems with a cantilevered thin elongated polyurethane elastomeric cleaning blade strip are commercially embodied in the Xerox Corporation "4000" and "4500" and "3100" xerographic copiers. The present invention represents a development in the above-cited technology, and accordingly these references are all hereby incorporated by reference in the present specification.

One problem in the use of such cleaning blade systems for cleaning moving xerographic photoreceptor imaging surfaces of imaging material has been in the mounting or support of the blade, particularly with compressable elastomeric blades. If the blade is compressed, or not completely linearly supported at its mounting edge it may not uniformly engage the imaging surface being repeatedly rotated past the blade edge. This can cause localized cleaning failures causing streaks on the copies, or total cleaning failures as by blade "tuck-under".

Various blade mounting or clamping arrangements for cleaning blades are, of course, known for various cleaning blade systems used in other than xerography, for example, those shown in U.S. Pat. No. 3,610,203, issued Oct. 5, 1971, and 3,097,390, issued July 16, 1963.

Of the above cited patents, it will be noted that, for example, in FIG. 4 of U.S. Pat. Nos. 3,848,992 and 3,724,019, and in FIG. 6 of U.S. Pat. No. 3,871,762, there is illustrated an additional groove or recess in the mounting base of the blade mounting channel. This provides a relief of clearance to protect the cleaning tip edge of the blade where the blade is intended to be reversible.

Compression of the blade non-uniformly, as by non-uniformly clamping the mounting edge of the blade, can cause non-linearities or other distortions of the opposite or cleaning edge of the blade engaging the photoreceptor. Likewise, it is desirable to have the cleaning blade formed as a monolithic elastomer strip without mounting holes or other discontinuities therein which can cause distortions of the blade. Also, it is desired to be able to easily manually remove the blade so as to reverse it or replace it.

It is known to loosely mount the cleaning blade in a channel having linear parallel sides spaced apart by a distance greater than the thickness of the blade, as in the Xerox "4000" copier, and as shown in several of the above patents. Normal manufacturing tolerances dictate that this mounting slot or channel always be made somewhat larger than the blade to avoid compression of the blade and to enable it to be readily inserted in the slot. This eliminates any compression of the blade and allows the blade mounting edge to firmly seat against the linear bottom surface or base of this mounting channel of the blade holder. However, this does not provide positive retention of the blade. Thus, if the blade is transversely translated by the blade holder, as is known and desired, slipping may occur between the blade and its holder. Further, if it is desired to mount the blade in a downwardly inclined orientation, with the mounting channel downwardly inclined, the blade may fall out of the blade holder unless it is adhesively or otherwise secured thereto. A further disadvantage of a conventional loose or oversized mounting channel for the blade is that the loose toner particles removed by the cleaning blade can fall down between the side of the blade and the side of the mounting channel. This toner build-up can cause difficulties, for example, building up in the channel under the base of the blade and affecting the blades mounting linearity.

The present invention is intended to provide a solution to the above and other problems of cleaning blade mountings for copying apparatus by providing a secure mounting of the blade to the holder without compression while maintaining blade linearity and also providing a seal for preventing toner from entering the base of the blade holder, yet still allowing easy manual insertion and removal of the cleaning blade from the blade holder without additional fastening means. With the system disclosed hereinbelow the blade may be maintained in an upside-down or any other desired orientation, held solely by the friction between the cleaning blade and its holder, without a pressure clamp, adhesive, or other fastening means, yet with an oversize and non-critical fixed mounting channel width.

Further objects, features and advantages of the present invention pertain to the particular structure and function whereby the above-stated features are provided. Accordingly, the invention will be better understood by reference to the following description of one exemplary embodiment thereof, including the single figure drawing forming a part thereof which is substantially to scale and comprises a cross-sectional view of the exemplary embodiment of the present cleaning blade system.

Referring now to the FIGURE, there is shown therein an exemplary cleaning system 10 in accordance with the present invention for cleaning toner from the moving photoreceptive imaging surface 12 of the xerographic drum or belt 14. The entire imaging surface 12 is cleaned by a cantilevered cleaning blade 16 resiliently pressed thereagainst extending linearly transverse the direction of movement of the imaging surface 12. The cleaning blade 16 is preferably a conventional monolithic, uninterrupted, resilient elastomeric linear strip of uniform cross-sectional dimensions and having two continuous opposing edges 18 and 20. Both of these edges may be adapted to clean the imaging surface 12. One edge, the cleaning edge 20, is resiliently held across the imaging surface to remove the toner therefrom. A portion of the opposite or mounting edge 18 of the cleaning blade is mounted to a blade holder 22.

Considering now in detail the blade holder 22, the blade 16 is mounted thereto solely by being manually mounted within a uniformly linearly extending U-shaped channel or slot 24. This channel 24 extends with the same cross-sectional configuration across the entire width of the imaging surface to be cleaned, for completely and uniformly supporting the blade 16. The channel 24 has a blade receiving opening 26 towards the imaging surface extending continuously along the outer surface of blade holder 22. The opposite end or bottom of the channel 24 has a linear base surface 28 adapted to linearly support the base of the blade mounting edge 18.

The blade retaining channel 24 has opposing generally parallel walls 30 and 32 spaced apart, by a distance slightly greater than the thickness of the cleaning blade 16, and extending continuously from the base 28 of the channel up to the channel opening 26 to provide unobstructed ingress of the cleaning blade through the channel 24 up to the base 28 without compression of the cleaning blade.

Differing from a conventional blade holder mounting channel 24 is the provision of a non-linear or arcuate bend 34 in the channel 24, intermediately of the base 28 and the opening 26. This central bend or change in direction of the channel 24 is sufficient to cause the cleaning blade 16, upon its insertion past this point, to arcuately resiliently bend slightly within the channel 24 sufficiently to cause the cleaning blade to resiliently frictionally engage both of the opposing walls 30 and 32 of the channel. The blade deformation and the blade resiliency causes a relatively high contact pressure between the blade and minor areas of the walls 30 and 32, which thereby provide contacts for frictionally engaging the blade within the channel 24. In the structure here it may be seen that the points of pressure contact between the blade and the channel 24 are only at contact areas 36, 38 and 40.

The curvature 34 of the channel 24 is in a direction toward the imaging surface, so that the contact area 36 on the toner removing side of the cleaning blade 16 is against the wall 30 of the channel 24 facing this toner cleaning side of the blade and also is at, or adjacent, the opening 26 of the channel. This provides a seal between the toner contaminated side of the blade 16 and the opening edge of the channel 24 to prevent the image developer material or other contaminants from entering the channel 24. Likewise, the opposing contact area 38 provides an additional seal at the opposite side of the blade and channel. Thus, image developer material is prevented from entering the channel 24 to any significant extent, and in particular from working its way down into the base 28 of the channel where it could affect the desired linear abutment of the base of the blade with its mounting base 28. Thus, when the blade is reversed or a new blade is inserted the excess clearance provided by the channel inter-wall perpendicular spacing and the absence of a substantial quantity of toner contamination allows unobstructed penetration of the blade to a smooth base 28 with low manual pressure.

In the embodiment illustrated here the blade retaining channel 24 is divided into two linear segments with a single sharp angular transition therebetween approximately centrally of the channel 24 between the base 28 and the opening 26. This arcuate bend in the channel is approximately 15°. It has been found that this angle provides adequate blade retention for the downwardly inclined (downwardly opening) channel illustrated and allows mounting of the cleaning blade to the blade holder 22 solely by the resilient frictional engagement within the channel 24 so provided. Greater than 15° arcuate bending of the channel may be provided providing the increase in the channel arcuity or curvature does not cause an excessive insertion force or excessive deformation of the blade. With angles much less than 15° the tolerance between the blade thickness and the spacing between the channel walls, i.e., the degree of clearance which can be provided, will be reduced if adequate blade retention is to be provided against the falling out of the blade by gravity or the translation of the blade holder 22 with the blade frictionally engaging the imaging surface.

While a single arcuate bend is illustrated in the FIGURE, it will be appreciated that, as alternative embodiments, the arcuate deformation may be accomplished by plural arcuate bends, i.e., providing a multi-angle or multi-faceted channel configuration, or providing a curved channel configuration. These alternative configurations would similarly force the blade to be positively located against a control surface for alignment and contaminant sealing and similarly capture the blade in the holder with similar advantages, providing the perpendicular spacing between the walls of the channel is maintained uniformly throughout the channel slightly greater than the thickness of the blade mounting edge.

In conclusion, it may be seen that there is provided herein an improved cleaning blade system. No separate or additional fastening means, which could cause non-uniform compression of the blade are required. The blade itself provides its own fastening and its own seal within the channel even though the channel is substantially larger than the blade. While the exemplary embodiment described herein is presently considered to be preferred, various other modifications or improvements will be apparent to those skilled in the art. The following claims are intended to cover all such variations and modifications as fall within the true spirit and scope of the invention.

What is claimed is:

1. In a copying apparatus wherein image developer material is cleaned from a reusable imaging surface by a resilient elongated cleaning blade with a cleaning edge in cleaning engagement with said imaging surface, and wherein said blade has a mounting edge mounted in a blade supporting member, and wherein said blade is a normally planar elastomeric strip with parallel surfaces spaced apart by the thickness of the cleaning blade, the improvement comprising:

a blade retaining channel in said blade supporting member with a blade receiving opening, said blade retaining channel having a linear bottom base surface linearly supporting said mounting edge of said blade, said blade retaining channel having opposing generally planar and parallel walls spaced apart continuously from said channel base surface to said channel opening by a distance slightly greater than said thickness of said cleaning blade to provide unobstructed insertion of said cleaning blade through said channel to said base surface thereof without compression of said cleaning blade, said blade retaining channel having generally two linear segments with a slight angular transitional bend therebetween located intermediately between said base surface and said channel opening, said bend being sufficiently arcuate to resiliently bend said cleaning blade within said channel sufficiently to resiliently frictionally engage said cleaning blade against both of said opposing walls of said blade retaining channel to retain said cleaning blade within said channel against said base surface and to seal said base surface from said image developer material, said cleaning blade being retained in said blade supporting member solely by said resilient frictional engagement of said cleaning blade within said blade retaining channel.

2. The copying apparatus of claim 1, wherein said blade retaining channel is downwardly inclined and downwardly opening and said cleaning blade is mounted to said blade supporting member solely by said resilient frictional engagement within said channel.

3. The copying apparatus of claim 1, wherein said arcuate bend in said blade retaining channel is approximately fifteen degrees.

* * * * *